United States Patent [19]

Hayashi et al.

[11] 4,051,287

[45] Sept. 27, 1977

[54] RAISED WOVEN OR KNITTED FABRIC AND PROCESS FOR PRODUCING THE SAME

[75] Inventors: Kazushige Hayashi; Norihiro Minemura, both of Ibaraki; Iwao Fujimoto, Waki; Kiyotaka Ozaki, Iwakuni; Norio Yoshida, Ibaraki; Toshio Morishita, Iwakuni; Takanori Shinoki, Matsuyama, all of Japan

[73] Assignee: Teijin Limited, Osaka, Japan

[21] Appl. No.: 638,595

[22] Filed: Dec. 8, 1975

[30] Foreign Application Priority Data

Dec. 12, 1974 Japan ..... 49-142040

[51] Int. Cl.[2] ..... B32B 7/00

[52] U.S. Cl. ..... 428/91; 28/162; 264/171; 264/177 F; 428/253; 428/257; 428/258; 428/259; 428/272; 428/373; 428/398

[58] Field of Search ..... 428/35, 36, 91, 224, 428/253, 257, 259, 373, 374, 397, 398, 178, 272; 264/150, 151, 177 F, 209, 210 F, 171; 166/175; 401/198, 199, 265, 284, 292; 28/72 P, 74 P, 76 P

[56] References Cited

U.S. PATENT DOCUMENTS

| | | | |
|---|---|---|---|
| 3,338,216 | 8/1967 | Roller | 401/265 |
| 3,518,019 | 6/1970 | Kahamura | 401/265 |
| 3,538,208 | 11/1970 | Otsuka | 264/151 |
| 3,586,454 | 6/1971 | Funakashi | 401/242 |
| 3,604,817 | 9/1971 | Funakashi | 401/284 |
| 3,614,247 | 10/1971 | Otsuka | 401/199 |
| 3,614,248 | 10/1971 | Otsuka | 401/292 |
| 3,687,561 | 8/1972 | Phillips | 401/265 |
| 3,718,401 | 2/1973 | Kirju | 401/265 |
| 3,729,270 | 4/1973 | Nakano | 401/292 |
| 3,744,923 | 7/1973 | Bok | 401/265 |
| 3,778,495 | 12/1973 | Wooley | 401/265 |
| 3,830,576 | 8/1974 | Kohno et al. | 401/265 |
| 3,933,965 | 1/1976 | Gallone et al. | 428/398 |

*Primary Examiner*—James J. Bell
*Attorney, Agent, or Firm*—Burgess, Ryan and Wayne

[57] ABSTRACT

A suede-like or deer skin-like raised woven or knitted fabric having at least one raised surface is produced by providing a woven or knitted fabric using a yarn consisting of synthetic hollow composite fibers each composed of two or more fiber-forming polyester constituents and two or more fiber-forming polyamide constituents and having a hollow space surrounded by the polyamide and polyester constituents which are arranged alternately with each other and adhered to each other side-by-side so as to form a tube-shaped body, and raising a surface of the fabric while allowing the hollow composite fibers located in at least the raised surface portion of the fabric to be divided into numerous very fine fibrils consisting of said polyester and polyamide constituents.

40 Claims, 11 Drawing Figures

(400X)

(180X)

(385X)

RAISED WOVEN OR KNITTED FABRIC AND PROCESS FOR PRODUCING THE SAME

The present invention relates to a raised woven or knitted fabric and a process for producing the same. More particularly the present invention relates to a raised woven or knitted fabric having at least one raised surface portion composed of numerous very fine fibrils and a process for producing the same.

It is known that in order to provide an artificial sheet material having suede-like or deer skin-like appearance and feel, it is necessary to cover the surface of the sheet material with very fine fibrils having a denier of at maximum 0.5 in a high density. However, it is very difficult to produce very fine fibers having a denier smaller than 0.5 by a conventional melt spinning-drawing process. Even with very fine fibers having a denier smaller than 0.5, such very small denier of the fibers results in difficulty in the processing thereof.

Many attempts have been made to produce very fine fibers. For example, a composite fiber has been provided by incorporating a polyamide filamentary constituent and a polyester filamentary constituent side-by-side to form a body. This simple type of composite fiber can be divided into polyamide and polyester fibers by applying a heat-treating or crumpling operation to said composite fiber. However, the simple side-by-side type composite fiber has a disadvantage in that the polyester and polyamide constituents are undesirably separated from each other in the processing operations, for example, drawing, texturing, winding and spinning operations. Said easy separation results in difficulty during the processing operations.

In one attempt to avoid said separation of constituents in the processing operations, simple side-by-side type composite fibers are treated with a non-aqueous finishing agent and are then further treated with an aqueous finishing solution. The finished fibers can be divided into individual constituents by treatment with boiling water. However, the use of said non-aqueous finishing agent results in disadvantages in processing control, environmental control and treatment of the waste agent.

Another attempt was made to provide composite fibers which can be processed without difficulty and which also are capable of being converted into very fine fibers. In this attempt, the composite fiber is an islands-in-sea type composite fiber wherein a plurality of island filamentary constituents are embedded in a sea filamentary constituent. The islands-in-sea type composite fiber can be converted into a bundle of the island constituent fibers by removing the sea constituent from said composite fiber. This type of composite fiber is disadvantageous in that the sea constituent is not utilized in the end use of the fiber. It is also disadvantageous in that the removal of the sea constituent requires the use of an organic solvent. A further disadvantage of the islands-in-sea type composite fiber is that the removal of the sea constituent results in a large change in the weight, volume and density of the fiber article. The above-mentioned disadvantages in turn result in the high cost of the end products from the composite fibers and in the difficulty of processing control, environmental control and treatment of solvent waste.

An object of the present invention is to provide a raised woven or knitted fabric having at least one raised surface covered by very fine fibrils in a high density, and a process for producing the same.

Another object of the present invention is to provide a raised woven or knitted fabric having a raised surface covered by very fine polyester and polyamide fibrils, and a process for producing the same.

A further object of the present invention is to provide a raised woven or knitted fabric having a suedelike or deer skin-like feel and appearance, and a process for producing the same.

The above-mentioned objects can be attained by the raised woven or knitted fabric having at least one raised surface, of the present invention, which comprises at least one yarn consisting of synthetic hollow composite fibers each composed of at least two constituents consisting of a fiber-forming polyester and at least two constituents consisting of a fiber-forming polyamide and having a hollow space formed within said fiber, in which fiber said polyester and polyamide constituents and said hollow space extend along the longitudinal axis of said fiber, and said polyester constituents and said polyamide constituents are arranged alternately with each other around said hollow space and adhered to each other side-by-side to form a tube-shaped body, said polyester and polyamide constituents in said composite fibers located in at least said raised surface portion of said fabric, being separated from each other to form numerous very fine fibrils. The above-mentioned raised woven or knitted fabric can be produced by the process of the present invention, which comprises:

providing synthetic hollow composite fibers each composed of at least two constituents consisting of a fiber-forming polyester and at least two constituents consisting of a fiber-forming polyamide and having a hollow space formed within said fiber, said polyester and polyamide constituents and said hollow space extending along the longitudinal axis of said fiber, and said polyester constituents and said polyamide constituents are arranged alternately with each other around said hollow space and are adhered to each other side-by-side to form a tube-shaped body;

forming a yarn from said synthetic composite fibers;

providing a woven or knitted fabric comprising at least one said yarn, and;

raising at least one surface of said fabric while allowing said hollow composite fibers located in at least said raised surface to be divided into very fine fibrils consisting of said polyester and polyamide constituents.

Further features and advantages of the present invention will become apparent from the following descriptions, reference being made to the attached drawings in which.

Figure 1:
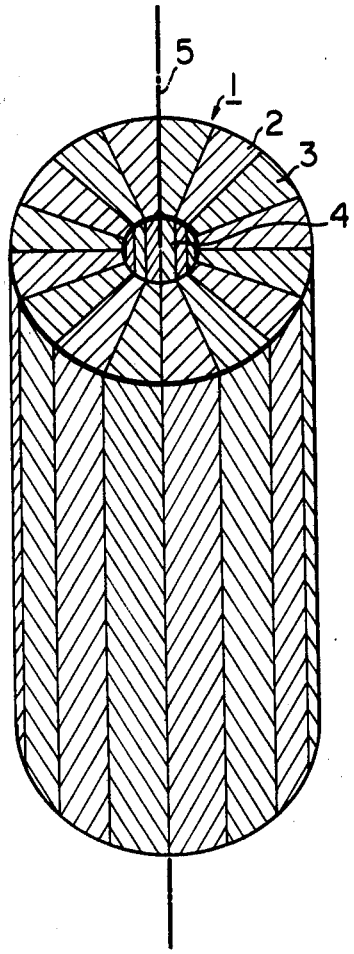
FIG. 1 is an explanatory perspective view of an embodiment of the hollow composite fibers usable for the present invention.

FIG. 1 shows an explanatory schematic view of an embodiment of the hollow composite fibers of the present invention. In the drawing, the composite fiber is composed of eight first constituents 2 consisting of a fiber-forming polyamide and eight second constituents 3 consisting of a fiber-forming polyester, and has a hollow space 4 formed within the fiber 1. Said polyamide and polyester constituents 2 and 3 as well as the hollow space 4 extend along the longitudinal axis 5 of said fiber 1.

The polyamide constituents 2 and the polyester constituents 3 are arranged alternately with each other around the hollow space 4 and adhered to each oher side-by-side so as to form a tube-shaped fiber body. In the embodiment of FIG. 1, the hollow space 4 is formed around the longitudinal axis 5 of the fiber 1 and the polyamide and polyester constituents 2 and 3 are regularly arranged around said hollow space 4. However, said hollow space 4 may be formed eccentrically with respect to the longitudinal axis 5. Also, the polyamide and polyester constituents 2 and 3 may be arranged irregularly around the hollow space 4, and may have different cross-sectional configurations and areas.

The composite fiber of the present invention may be composed of at least 2, and preferably 3 to 20 of the polyamide constituents and of the same number of polyester constituents. The ratio of the total weight of the polyamide constituents to that of the polyester constituents is not limited. However, a preferable ratio is between 30:70 and 70:30.

The fiber-forming polyester for the polyester constituents may be selected from the group consisting of: (1) alkylene terephthalate homopolyesters, in which the alkylene group is derived from polymethylene glycol of the formula: $HO—(CH_2)_p—OH$, wherein p represents an integer from 2 to 10; (2) alkylene terephthalate — metal sulfonate copolyesters, in which the alkylene group is the same as defined above and the metal sulfonate group is of the formula:

$$-X-\underset{\underset{SO_3M}{|}}{Z}-Y-$$

wherein M represents a metal atom, and X represents an atomic group of the formula:

$$-O-\underset{\underset{O}{\|}}{C}-O-$$

$$-O-(CH_2)_n-[O-(CH_2)_n]_m-O-$$

$$-\underset{\underset{O}{\|}}{C}-[O-(CH_2)_n]_m-O-$$

wherein n represents an integer of 1 or more and m represents zero or an integer of 1 or more, Y represents the same group as X or a hydrogen atom and Z represents a divalent arylen group or a divalent alkylene group which bonds said $—SO_3M$ group to said X group through at least 3 atoms; (3) alkylene terephthalate — third ingredient copolyesters, in which the alkylene group is the same as defined above and the third ingredient is derived from at least one compound selected from the group consisting of adipic acid, sebacic acid, isophthalic acid, diphenylsulfondicarboxylic acid, naphthalene-dicarboxylic acid, hydroxybenzoic acid, trimethylene glycol, propylene glycol, cyclohexane-dimethanol and neopentyl glycol, and; (4) alkylene terephthalate-metal sulfonate - fourth ingredient copolyesters, in which the alkylene group and the metal sulphonate group are the same as defined above and the fourth ingredient is the same as the third ingredient defined in item (3) above.

The alkylene terephthalate homopolyester may be either polyethylene terephthalate, or polytetramethylene terephthalate. In the metal sulfonate group in the copolyesters, the metal atom may be selected from the group consisting of alkali metals such as strontium, sodium and potassium, and alkaline earth metals such as barium, calcium and magnesium. The third ingredient in the alkylene terephthalate — third ingredient copolyester is preferably in an amount of 10% or less, based on the amount by mole of the alkylene telephthalate ingredient. The fourth ingredient in the alkylene terephthalate-metal sulfonate — fourth ingredient copolyester is preferably in an amount of 10% or less, based on the sum of the amounts by mole of the alkylene terephthalate and metal sulfonate ingredients.

In the copolyesters of the above-mentioned item (2), containing therein the metal sulfonate group, it is preferable that the amount by mole of said metal sulfonate group be 0.01 to 1.0%, more preferably, 0.05 to 0.5%, and most preferably, 0.1 to 0.3%, based on the sum of the amount by mole of the terephthalic acid ingredient and the metal sulfonate group. The amount of said metal sulfonate group in the copolyesters of the above-mentioned item (4) is preferably in the same percentage as mentioned above, based on the sum of the amounts by mole of the terephthalic acid ingredient, the metal sulfonate group and the fourth ingredient when it is an acid. The amount of the metal sulfonate group to be contained in the terephthalate copolyesters may be adjusted in consideration of the types of fiber-forming polyester and polyamide to be used in the composite fiber, the number of the polyamide and polyester constituents in the composite fiber, the denier of the individual fiber and the processes to be used for converting the composite fibers into the proposed product. Generally, the larger the content of the metal sulfonate group in the copolyester, the larger the adhering intensity of the resultant copolyester constituents to the polyamide constituents, and the smaller the content of the metal sulfonate group, the poorer the adhering intensity between the copolyester constituents and the polyamide constituents. The compound from which the metal sulfonate group in the copolyesters is derived, may be 3,5-dicarboxybenzene sulfonic acid.

The fiber-forming polyester for the polyester constituents may be a blend of two or more of the above-mentioned homo-polyesters and the copolyesters. The fiber-forming polyamide for the polyamide constituents may be selected from the group consisting of nylon 4, nylon 6, nylon 66, nylon 7, nylon 610, nylon 11, nylon 12, polyamides of bis(p-aminocyclohexyl)methane with a dicarboxylic acid such as 1,7-heptanedicarboxylic acid and 1,10-decamethylene-dicarboxylic acid, copolyamides of two or more of the above-mentioned polyamides and mixtures of two or more of the above-mentioned polyamides and copolyamides.

Both or either the fiber-forming polyester and/or polyamide may be mixed with 1 to 15% by weight of an anti-static agent, for example, a mixture of the compounds of the formulae:

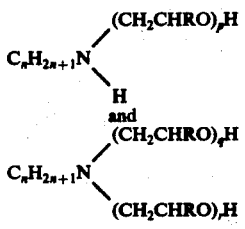

wherein R represents a hydrogen atom or methyl group, *p*, *q* and r are an integer of 1 or more, respectively and *n* represents an integer of 10 or more. Both or either the polyester and/or polyamide constituent may contain therein a delustering agent such as titanium dioxide, a coloring agent, for example, carbon black and an antioxidizing agent of thermal stabilizer.

In the composite fiber of the present invention, each of the polyamide constituents comes into contact with only polyester constituents which have a poor adhesive intensity to the polyamide constituents. Accordingly, the polyester and polyamide constituents can be easily separated from each other so as to convert the composite fiber into a bundle of very fine fibers consisting of individual polyester and polyamide constituents. If the composite fiber had no hollow space and the constituents converged to the longitudinal axis of the fiber, each constituent would be connected to other constituents at the longitudinal axis portion and/or the constituent polymers would be mixed with each other at the longitudinal axis portion of the fiber. The connection and mixing mentioned above causes difficulty in the separation of the constituents. In the composite fiber of the present invention, there is no limitation with regard to the hollow ratio, which is a ratio by volume of the hollow space to the sum of the polyamide and polyester constituents and the hollow space. However, it is preferable that the hollow ratio be between 0.1 and 15% by volume, more preferably, between 1 and 10% by volume. The hollow ratio can be determined by the following method. A cross-sectional profile at some point along the composite fiber is observed. in the profile, the cross-sectional area of the hollow space and the cross-sectional area of the fiber body are measured. The ratio of the cross-sectional area of the hollow space to that of the fiber body is determined. The same procedures are repeated several times at different points along the fiber. The hollow ratio of the fiber is represented by a mean value of the determined values of the ratio. When the composite fibers have a hollow ratio between 0.1 and 15% by volume, the composite fibers can be processed, for example, in a melt-spinning operation, a drawing operation, a texturing operation, a spun yarn-spinning operation including carding, a weaving operation and a knitting operation, without separation of the individual constituents from each other, and such composite fibers can be easily divided into individual constituents by a raising operation and/or thermal shrinking operation.

In the composite fibers of the present invention, there is no limitation with regard to the tensile strength of the fibers. However, when the composite fibers have a preferable tensile strength between 2 to 6 g/denier, more preferably, 3.5 and 5.0 g/denier, the composite fibers can be processed in various operations, for example, spun yarn spinning, weaving and knitting operations, without breakage of the fibers or fiber yarns, and further, the raising operation for the composite fiber fabric can be smoothly effected without difficulty. In addition, it will be observed that the raised surface of the fabric has a high resistance to pill formation. In the present invention, it is preferable that the individual polyester and polyamide constituents in the composite fibers respectively have a denier of from 0.0001 to 0.4, more preferably, from 0.02 to 0.3. The composite fibers composed of the above-mentioned very fine individual constituents are suitable for producing suede-like fabric, the surface of which is covered by numerous very fine fibrils formed from the divided individual constituents.

It should be noted that the hollow composite fibers of the present invention may have a regular or irregular cross-sectional profile.

The hollow composite fibers of the present invention have the following advantages.

1. Since the composite fibers have a hollow space, the apparent density of the fibers is relatively low and the resultant fabric is light and bulky.

2. Since the individual constituents are incorporated into each other so as to form a hollow tube, it is possible to industrially manufacture a hollow composite fiber composed of a large number, for example, 10 or more, of the individual constituents having an extremely small denier by a relatively simple melt-spinning apparatus.

3. Since each of the individual constituents are only adhered to a different polymer of the constituents and not to the same polymer thereof, said constituents can be easily separated from each other by imparting mechanical impacts, for example, raising, crumpling and beating, to the composite fibers.

4. The hollow composite fibers have a relatively high tensile strength.

Figure 2:
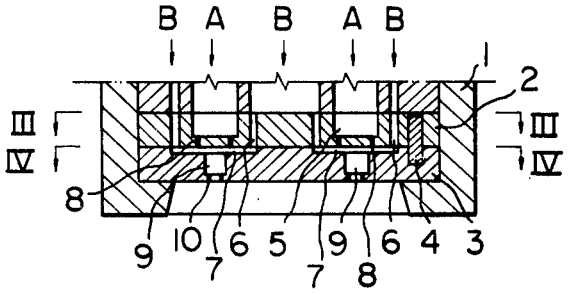
FIG. 2 is an explanatory vertical cross-sectional view of an embodiment of a melt-spinning apparatus for producing the hollow composite fibers of the present invention.
Figure 3:
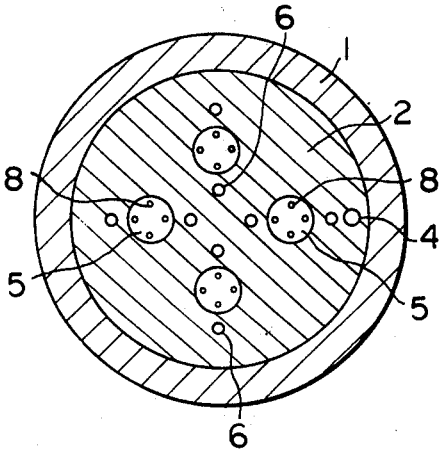
FIG. 3 is an explanatory horizontal cross-sectional view of the melt-spinning apparatus of FIG. 2 along line III—III of FIG. 2.
Figure 4:
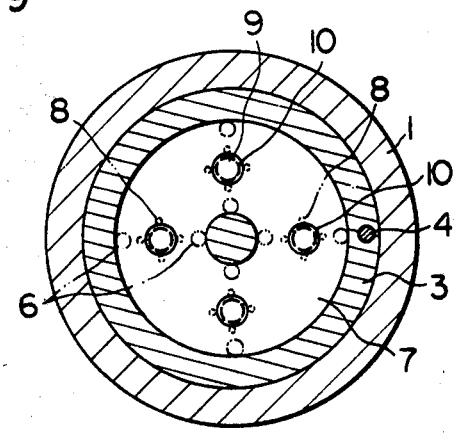
FIG. 4 is an explanatory horizontal cross-sectional view of the melt-spinning apparatus of FIG. 2 along line IV—IV of FIG. 2.

FIGS. 2, 3 and 4 show an embodiment of the apparatus for producing the composite fibers of the present invention each of which is composed of four first polyester constituents and four second polyamide constituents. Referring to these figures, a packing case 1 contains therein an upper plate 2 and lower plate 3, which are superimposed and fixed by a pin 4. The upper plate 2 has four distribution chambers 5 for a melt A and eight feed passages 6 for a polyester melt B. Said feed passages 6 for the polyamide melt are connected to a uniting chamber 7 formed in the lower plate 3. Each of the distribution chambers 5 are connected to the uniting chamber 7 through four distribution passages 8 for said melt A. The uniting chamber 7 is connected to four spinning chambers 9. Each of the spinning chambers 9 is connected to four spinning orifices 10 each of which has an arc-shaped cross-sectional profile. It is preferable that the diameter of a circle circumscribed about the outer arc-shaped periphery of the cross-sectional profiles of the orifices, ranges between 0.6 and 3.0 mm and the width of the orifices ranges between 0.1 and 0.3 mm.

In a spinning operation for producing the composite fiber of the present invention by using the apparatus of FIGS. 2, 3 and 4, the melt A is supplied into the distribution chambers 5 and fed into the uniting chamber 7 through the distribution passages 8 in order to form sixteen streams of said melt a in said uniting chamber 7. The streams of the melt A thus formed are separate from each other. A melt B is fed into the uniting chamber 7 through the feed passage 6 and incorporated into the streams of said melt A. The incorporated melts are then distributed into the spinning chambers 9. Each of said spinning chambers 9 receive a composite stream composed of four streams of melt A each surrounded by melt B. Each of said composite streams in the spinning chambers 9 is distributed into four spinning orifices 10 so that each composite stream is divided into four divisional composite streams, each of which is composed of a stream of the melt A interposed between two streams of the melt B.

Said divisional composite streams are extruded through the orifices 10 at a temperature of 250° to 300° C. When the four divisional composite streams have passed through these orifices, they expand in their cross-sectional area due to the Baras effect. This expansion results in contact of the divisional composite streams with each other so as to form a hollow composite filamentary stream. Said hollow composite filamentary stream thus formed is solidified by cooling and then finished with a finishing liquid containing an anti-static agent. In the spinning process, it is preferable that the polyester and polyamide melts in the spinning chamber have a viscosity of 1000 to 3500 poises and that the difference in viscosity between the polyester and polyamide melts is smaller than 2000 poises, more preferably, between 200 and 1800 poises. In the extruding operation, it is also preferable that in each unit of orifices per hollow composite filament, an extruding linear velocity S in m/min of the composite melt stream and an extruding rate Q in g/min of the sum of the melts, satisfy the following relationships:

$$0.33Q^2 - 2.81Q + 8.48 \leqq S \leqq \frac{480}{Q+5} - 4$$

$$1 \leqq Q \leqq 4$$

In the melt-spinning operation, it is preferable that the take-up speed of the hollow composite filaments is between 500 and 4000 m/min. and that the draft ratio is between 100 and 3500.

Figure 5:
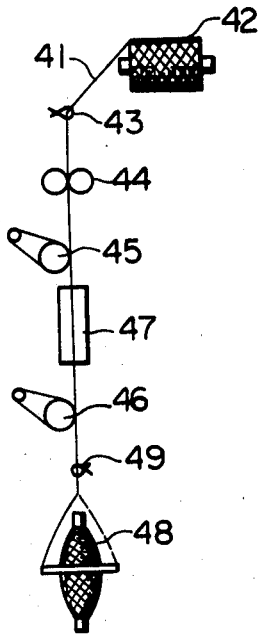
FIG. 5 is an explanatory schematic view of an embodiment of a drawing apparatus for the hollow composite fiber of the present invention.

In order to produce a continuous composite filament yarn, the finished composite filaments are subjected to a drawing operation using a drawing apparatus, for example, the one depicted in FIG. 5.

Referring to FIG. 5, undrawn composite filaments 41 which have been supplied from a yarn package 42, are fed into the drawing apparatus through a guide 43 and a pair of rollers 44. The drawing apparatus has a feed roller 45 having a heating device (not shown) located therein, a draw roller 46 and, if desired, a heating device 47. The composite filaments 41 are fed onto said feed roller 45, which has a temperature of 20° to 100° C, and are then drawn between said feed roller 45 and the draw roller 46 at a draw ratio of 1.5 to 4.0. The drawn composite filaments are heated in a heating device, for example, a slit heater 47, at a temperature between 100° and 200° C, and the resultant straight composite filament yarn is then wound up on a bobbin 48 after passing through a guide 49.

In order to produce staple composite fibers, a plurality of the undrawn filament bundles are incorporated to form a tow, which is processed in the following manner. Said tow is fed onto a feed roller, having a temperature of 50° to 100° C and drawn between the feed roller and a delivery roller at a draw ratio of 1.5 to 4.0. Generally, the drawn filament tow is crimped, for example, at 8 to 15 crimps per inch, by using a crimping machine, for example, a stuffing box. It it is necessary, the crimped filament tow is heat-set at a temperature of 20° to 120° C. Thereafter, the crimped composite filament tow is cut to form staple fibers having a desired length, for example, 38 to 150 mm. The staple fibers thus prepared are converted into a spun yarn by a conventional spinning process.

The straight composite filament yarn of the present invention can be textured without difficulty by a conventional texturing method, for example, a false-twisting method. The straight and textured hollow composite filament yarns and the spun hollow composite fiber yarns can be used for producing a woven or knitted fabric by a conventional method. In order for said woven or knitted fabric to be used as a primary fabric to be converted into a raised fabric, it is desirable that the surface portion to be raised of the primary fabric be composed essentially of the hollow composite fibers of the present invention.

That is, when the primary fabric is a woven fabric, it is desired that at least the weft thereof consists of a hollow composite filament straight or textured yarn or a hollow composite staple fiber spun yarn. If this is the case, the warp of the primary woven fabric may be a yarn consisting of fibers other than the hollow composite filament or fiber, or may be a hollow composite filament or fiber yarn the same as or different from that of the weft. The yarn consisting of filaments or fibers other than the hollow composite filaments are fibers usable for the weft, may be a straight filament yarn; textured filament yarn by a false-twisting method; textured filament yarn by a method other than the false-twisting method, for example, stuffer crimping method, edge crimping method and air jet-crimping method; mixed filament yarn or a spun yarn. The weft yarn may be a dope-dyed yarn or a raw stock-dyed yarn may be dyed before the waving process. These types of dyed yarns are effective for promoting the brightness and the color build-up of the fabric when it is dyed.

When the primary fabric is a warp knitted fabric, it is preferable that the courses thereof are essentially formed by a straight or textured filament yarn or a spun yarn consisting of filaments or fibers other than the hollow composite filaments or fibers, and the wales thereof are essentially formed by a hollow composite filament straight or textured filament yarn or a hollow composite fiber spun yarn.

When the primary fabric is a circular knitted fabric, both the front and back portions or only the front portion thereof may be essentially formed by the hollow composite filament or fiber yarn. In the latter, the back portion of the fabric may be essentially formed by any type of yarn consisting of filaments or fibers other than the hollow composite filaments or fibers.

The primary woven or knitted fabric may be processed by any conventional process to produce the raised fabric of the present invention. The primary fabric can be processed by the processes indicated in FIGS. 6 through 8, for example.

Figure 6:
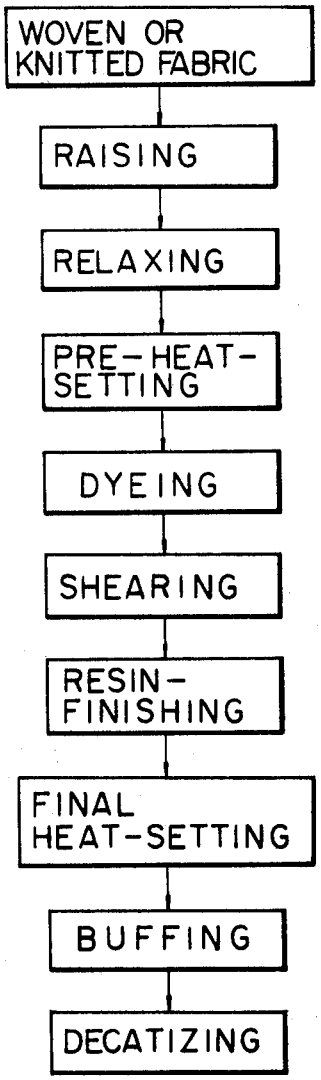
FIGS. 6 through 8 are respectively schematic block diagram of an embodiment of the processes for producing the raised woven or knitted fabric of the present invention.

Referring to FIG. 6, at least one surface of a woven or knitted fabric is raised using a raising machine with a card clothing, or a buffing machine with sand paper, cloth, net or belt, or emery paper or cloth, carrying thereon abrasive grains of a 40 to 400 mesh size. By means of said raising operation, the hollow composite fibers located in the surface portion are converted into numerous very fine fibrils. The raised fabric is relaxed by immersing it in a hot water bath having a temperature of 40° to 100° C, or by bringing the fabric into contact with flows of steam at a temperature of 80° to 140° C, or with jets of hot air at a temperature of 100° to 160° C. By means of the relaxing operation, the desired size and density of the fabric can be attained. The relaxed fabric is pre-heat set at a temperature of 160° to 190° C for 10 to 60 seconds in the desired size of the fabric. Thereafter, the fabric is dyed or printed by using a conventional method. The dyed or printed fabric is subjected to a shearing operation so as to adjust the very fine fibrils on the raised surface of the fabric to a desired length. The sheared fabric is finished by impregnating it with a conventional finishing resin, for example, an elastic polymer, by using a conventional method. Said resin-finishing is preferably carried out by impregnating the fabric with a solution or emulsion of elastic polymers, for example, natural rubber, synthetic rubber such as acrylonitrile-butadiene copolymer rubber, polychloroprene rubber, styrene-butadiene copolymer rubber, polybutadiene rubber, polyisoprene rubber, polyethylene-propylene rubber, acrylate-type copolymer rubber and silicone rubber; or non-elastic polymers, for example, polyurethane, polyacrylate, polyvinyl acetate and polyvinyl chloride. The impregnating operation may be effected by the immersion method, spraying method, foaming method, printing method or coating method. After the impregnating operation, the polymer is solidified or coagulated by any of the well-known methods. For example, the impregnated fabric is dried and is then heat-treated at a temperature at which the polymer on the fabric can be cured. The amount of the finishing resin to be applied to the fabric is determined in accordance with the required end use of the raised fabric, and preferably ranges from 0.1 to 5.0%, based on the weight of the fabric. The resin-finished fabric is finally heat-set in a desired size. The heat-set fabric is buffed to raise the piles on the surface. Thereafter, if necessary, the buffed fabric is decatized using a conventional method. The process of FIG. 6 is suitable for a knitted fabric.

Figure 7:
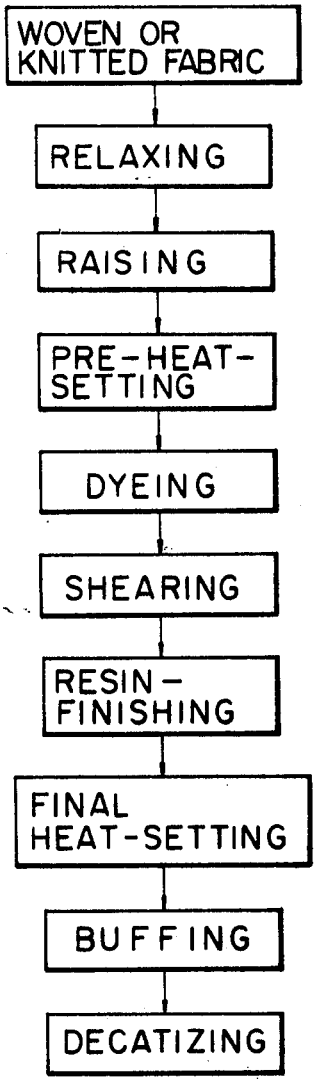

FIG. 7 shows another process for producing the raised fabric. In FIG. 7, the fabric is relaxed, and then raised. Thereafter, the raised fabric is processed by means of the same operations as those in FIG. 6. The process of FIG. 7 is more beneficial for woven fabrics than for knitted fabrics. In a modification of the process of FIG. 6, an additional raising operation may be applied to the relaxed fabric before the pre-heat setting operation. This modified process is also more beneficial for woven fabrics than for knitted fabrics. In a modification of the process of FIG. 7, an additional raising operation can be inserted between the dyeing and shearing steps. In another modification of the process of FIG. 7, an additional shearing operation can be applied between the pre-heat setting and dyeing steps.

Figure 8:
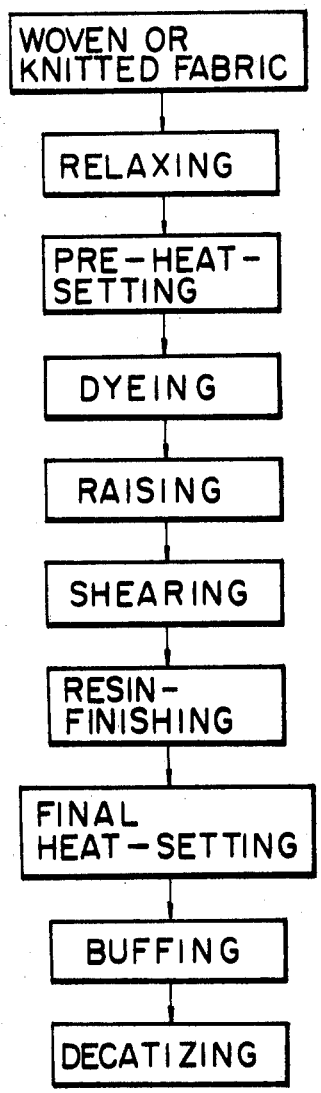

In the process of FIG. 8, the woven or knitted fabric is relaxed, pre-heat set and dyed, and thereafter, raised. The raised fabric is then further processed by means of the same operations as those in FIG. 6.

The raising and buffing operations are effective for dividing the composite fibers located in the surface portion to be raised of the fabric, so as to form numerous very fine fibrils on the surface thereof. That is, by means of the raising and buffing operations, only the composite fibers located in the surface portion to be raised are converted into numerous very fine fibrils. On the other hand, the composite fibers located in portions of the fabric other than the raised surface portion may be maintained in non-divided form even after the raising and buffing operations.

The relaxing operation is effective for promoting the dividing of the composite fibers. For this purpose, it is preferable to effect said relaxing operation to such a degree that the composite fibers are shrunk in a shrinkage of 20% or less, more preferably, 8 to 12%. Since the thermal shrinking property of the polyamide constituents is different from that of the polyester constituents, the above-mentioned shrinking of the hollow composite fibers results in the creation of stress at the intersurface between the polyamide and polyester constituents, which stress is effective for promoting the separation of the constituents from each other.

Needless to say, in the raised fabric of the present invention, all or a portion of the composite fibers located in portions of the fabric other than the raised surface portion may be converted into bundles of very fine fibers consisting of individual filamentary constituents. For this purpose, the woven or knitted fabric may be crumpled mechanically, by hand or by the action of fluid streams, or may be beaten mechanically or by jets of fluids, for example, air, steam or water. The crumpling or beating operation may be applied to the fabric during either or both the relaxing step and/or the dyeing step.

In the resultant raised fabric of the present invention, the raised surface is covered by numerous very fine piles having a denier of preferably, 0.001 to 0.4, more preferably, 0.02 to 3, and consisting of the polyamide and polyester. Accordingly, the raised fabric of the present invention has a suede-like or deer skin-like appearance and feel.

As stated hereinbefore, the hollow composite fibers usable for the present invention can be divided into a plurality of very fine fibrils easily by raising, crumpling or beating operations but are difficult to divide by the normal melt-spinning, drawing, texturing, waving or knitting operations. Therefore, the hollow composite fibers can be passed through the above-mentioned operations without difficulty. Generally, the very fine fibrils of the present invention have a wedge-shaped cross-sectional profile. This shape of said very fine fibrils has a small resistance to bending similar to that of fine fibrils in natural deer skin. Accordingly, the raised woven or knitted fabrics of the present invention have a deer skin-like appearance and feel. In the raised woven or knitted fabrics of the present invention, both the polyamide constituents and the polyester constituents are utilized to make the very fine fibrils on the raised surface of the fabric. That is, no constituent in the hollow composite fiber is eliminated to produce said very fine fibrils. The results are a low cost of the end product and no environmental pollution.

The raised woven or knitted fabric of the present invention may be a heavy fabric, light fabric or middle weight fabric and may be widely usable as clothing, for example, jackets, skirts, trousers, shorts, slacks, dresses, suits, vests, coats, and gloves, micro-filter cloths especially for filtering alcohols, printing ribbons for typewriters, optical computer recording devices, general computer recording devices, and artificial leathers for shoes, hand bags and brief cases.

The following examples are illustrative of the present invention but are not to be construed as limiting the scope of the present invention.

EXAMPLE 1

A copolyester was prepared by co-polycondensing dimethyl terephthalate, 0.25% of sodium-3,5-di-(carbomethoxy)-benzene sulfonate, based on the amount by mole of the dimethyl terephthalate, and ethylene glycol in an amount large enough to copolycondense with the above-mentioned terephthalate and sulfonate ingredients. The resultant copolyester had an intrinsic viscosity of 0.62, which was determined in O-chlorophenol at a temperature of 35° C. The above-prepared copolyester and poly-ε-caproamide, having an intrinsic viscosity of 1.30 determined in m-cresol at a temperature of 35° C, were used for producing hollow composite fibers each composed of 8 polyester constituents and 8 polyamide constituents. The same amounts of copolyester and poly-ε-caproamide were supplied into a melt-spinning apparatus, melted at a temperature of 270° C and extruded through 20 spinnerets at an extruding liner velocity of 5 m/min at an extruding rate of 1.7 g/min per orifice unit. The extruded hollow composite melts were solidified and taken up at a velocity of 1800 m/min.

Figure 9:
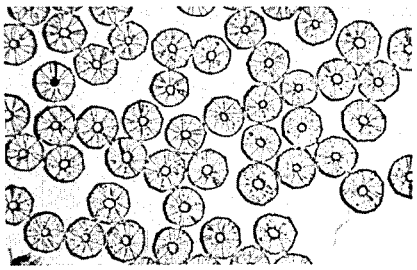
FIG. 9 is a microscopic cross-sectional view of an embodiment of the hollow composite fibers usable for the present invention at a magnification of 400.

The copolyester melt had a viscosity of 2500 poises and the polyamide melt had a viscosity of 3200 poises at a temperature of 270° C. The above-mentioned melt-spinning operation was carried out without breakage of the composite filaments. The resulting individual undrawn hollow composite filaments had a denier of 172.5. The undrawn filaments were fed into a drawing apparatus as shown in FIG. 5. In the apparatus, the filaments were wound four times on a heating roller having a diameter of 100 mm and heated at a temperature of 80° C, drawn between a feed roller and a draw roller at a draw ratio of 2.3 and, then, heat-set on a slit heater maintained at a temperature of 180° C. The heat-set filaments were delivered at a velocity of 500 m/min. During the period of the drawing operation, no difficulties were encountered. The resultant individual drawn composite fibers had a denier of 3.6 to 3.8 and cross-sectional profiles as shown in FIG. 9. In the composite fibers, the individual constituents had a denier of about 0.23. The resultant individual hollow composite fibers also had a tensile strength of 5.0 g/d, a breaking elongation of 25% a hollow ratio of 2.5% and a shrinkage of 12.0% in boiling water.

The hollow composite filament yarn prepared above, having a thickness of 75 denier was subjected to a texturing operation under the following conditions.

| | |
|---|---|
| False twising machine | Scragg CS 12–600 |
| Rotational rate of spindle | $28.6 \times 10^4$ r.p.m. |
| Twist number | 2700 T/m(Z-direction) |
| Temperature of heater | 175° C |
| Overfeed in texturing operation | 3% |
| Overfeed in winding operation | 4% |

A 5-ply satin was prepared from a warp consisting of the textured hollow composite filament yarn prepared above and a weft yarn consisting of a textured yarn consisting of 30 polyethylene terephthalate filaments and having a thickness of 150 denier and a twist rate of S120T/m. The resultant woven fabric was processed in accordance with the process indicated in FIG. 7. The fabric was relaxed in a hot water bath at a temperature of 100° C for 30 minutes and dried at a temperature of 120° C for 3 minutes. The dried fabric was raised five times with a French type raising machine and pre-heat set at a temperature of 170° C for 30 seconds using a pin tenter.

Thereafter, the pre-heat set fabric was dyed with an aqueous dyeing liquid containing 4%, based on the weight of the fabric, of Duranol Blue G (C.I. No. 63305, trademark of a disperse dye made by I.C.I.), 0.2 ml/l of acetic acid and 1 g/l of a dispersing agent (Disper TL, a trademark of Meisei Kagaku K.K.), at a temperature of 120° C for 60 minutes. After the completion of dyeing, the fabric was squeezed and dried at a temperature of 120° C for 3 minutes. The fabric was subjected to shearing operations four times. The sheared fabric was finished with a polyurethane in the following manner. The fabric was immersed in an aqueous emulsion of a 4% polyurethane (Elastron E-37, a trademark of Daiichi Kogyo Seiyaku K. K., Japan), and squeezed in such a manner that 56%, based on the weight of the fabric, of the emulsion was maintained in the fabric. The fabric was dried at a temperature of 120° C for 3 minutes and then cured at a temperature of 150° C for 30 seconds. By the curing operation for the resin, the fabric was finally heat-set. The fabric was buffed three times by a roller sander machine with sand paper carrying thereon abrasive grains of 250 mesh size. Finally, the fabric was decatized at a temperature of 100° C for 2 minutes.

Figure 10:
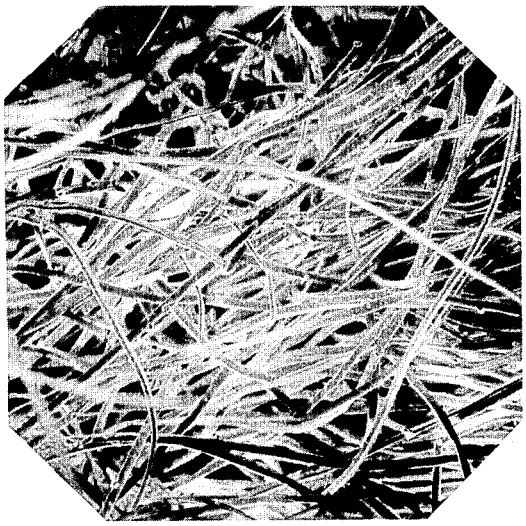
FIG. 10 is a microscopic view at a magnification of 180, of a surface portion of an embodiment of the raised woven fabric of the present invention.
Figure 11:
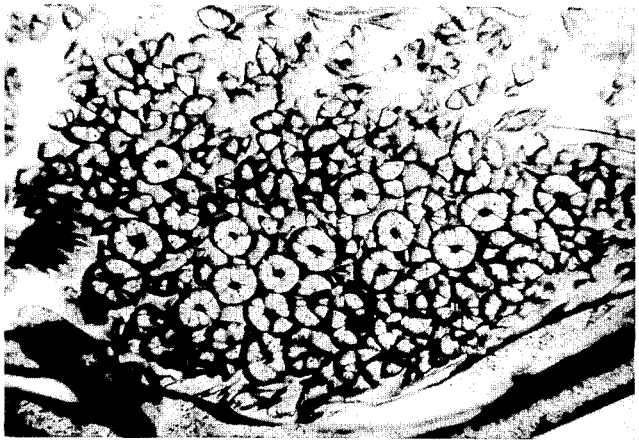
FIG. 11 is a microscopic cross-sectional view at a magnification of 385, of an embodiment of the raised woven fabric of the present invention.

The resultant raised fabric had a deer skin-like appearance and feel. A microscopic view of the raised surface of the resultant raised fabric is shown in FIG. 10, it will be seen that the surface of the fabric is covered by numerous extremely fine fibrils. In addition, a microscopic cross-sectional view of the raised fabric is shown in FIG. 11, wherein it is indicated that said raised surface portion of the fabric is formed by the very fine fibrils having a wedge-shaped cross-sectional profile and the inside portion of the fabric is composed of undivided hollow composite fibers. The resultant deer skin-like raised fabric had a high resistance to pilling and fingermarks appeared on the surface thereof.

EXAMPLE 2

Procedures identical to those in Example 1 were repeated, except that: 100 yarns of the undrawn hollow filaments were bundled to form a tow; the tow was drawn at a draw ratio of 2.3 using fine heating rollers maintained at a temperature of 80° C and having a diameter of 200 mm; the drawn tow was crimped by a stuffing box at a crimp number of 12 crimps/25 mm, dried at temperature of 100° C for 60 minutes, and, thereafter, cut to prepare staple fibers having a length of 51 mm. The drawing operation was carried out without difficulty. The resultant raised fabric had a suede-like appearance and feel, a high resistance to pilling and fingermarks appeared on the surface thereof.

EXAMPLE 3

The same textured hollow composite filament yarn as that in Example 1 was prepared. Two lengths of the textured yarn were paralleled and said paralleled (double) yarn was used as a front yarn to prepare a knitted fabric having a weight of 250 g/m², in which fabric a paralleled polyethylene terephthalate filament yarn having a denier of 150 was used as a back yarn. The knitted fabric was processed in accordance with the process indicated in FIG. 6. The knitted fabric was raised 5 times by a raising machine with a sander belt carrying thereon silicon carbide abrasive grains of 150 mesh size. Thereafter, the fabric was relaxed, pre-heat set, dyed, sheared, resin-finished, heat set, buffed and decatized under the same conditions as those in Example 1. The resultant raised knitted fabric had a suede-like appearance and feel, a high resistance to pilling and finger-marks appeared on the surface thereof.

EXAMPLE 4

Procedures identical to those in Example 1 were carried out, except that the sodium 3,5-di-(carbomethyoxy) benzene solfonate was used in an amount of 0.125%, based on the weight of the dimethyl terephthalate, and that an additional raising operation was applied to the woven fabric before the relaxing operation. The additional raising operation was carried out by passing the woven fabric through a card clothing type raising machine 4 times. The resultant hollow composite filaments had a hollow ratio of 5.2%, a tensile strength of 5.6 g/denier, a breaking elongation of 30% and a shrinkage of 13.2% in boiling water. The resultant raised fabric had a deer skin-like appearance and feel, and a high resistance to pilling. Preferable finger-marks were observed on the surface of the raised woven fabric.

EXAMPLE 5

A polyester was prepared by polycondensing dimethyl terephthalate, and tetramethylene glycol in an amount enough to polycondense with the above-mentioned terephthalate. The resultant polyester had an intrinsic viscosity of 0.87, which was determined in O-chlorophenol at a temperature of 35° C. The above-prepared polyester and poly-ε-caproamide, having an intrinsic viscosity of 1.10 determined in m-cresol at a temperature of 35° C, were used for producing hollow composite fibers, each composed of 16 polyester constituents and 16 polyamide constituents. The same amount of the polyester and poly-ε-caproamide were supplied into a melt-spinning apparatus, melted at a temperature of 250° C and extruded through 20 spinnerets at an extruding liner velocity of 1.0 m/min at an extruding rate of 0.8 g/min per orifice unit respectively. The extruded hollow composite melts were solidified and wound up at a velocity of 1200 m/min.

The polyester melt had a viscosity of 2500 poises and the polyamide melt had a viscosity of 2000 poises at a temperature of 250° C. The above-mentioned melt-spinning operation was carried out without breakage of the composite filaments. The resulting individual undrawn hollow composite filaments had a denier of 115. The undrawn filaments were fed into a drawing apparatus as shown in FIG. 5. In the apparatus, the filaments were wound 7 times on a roller having a diameter of 100 mm at an ambient temperature and were drawn between a feed roller and a delivery roller at a draw ratio of 2.4. The drawn filaments were delivered at a velocity of 600 m/min. During the period of the drawing operation, no difficulties were encountered. The resultant individual drawn composite fibers had a denier of 2.3 to 2.4. In the composite fibers, the individual constituents had a denier of 0.073. The resultant individual hollow composite fibers also had a tensile strength of 5.8 g/d, a breaking clongation of 28% a hollow ratio of 3.0% and a shrinkage of 13.6% in boiling water.

A 5-ply satin was prepared from a warp consisting of the hollow composite filament yarn having a thickness of 48 denier prepared above and a weft yarn consisting of a dope-dyed textured yarn containing 2.8% by weight of carbon black consisting of 30 polyethylene terephthalate filaments and having a thickness of 150 denier and a twist rate of S120T/m. The resultant woven fabric was processed in accordance with the process indicated in FIG. 7. The fabric was relaxed in a hot water bath at a temperature of 100° C for 30 minutes and dried at a temperature of 120° C for 30 minutes. The dried fabric was raised five times with a French type raising machine and pre-heat set at a temperature of 170° C for 30 seconds using a pin tenter.

Thereafter, the pre-heat set fabric was dyed with an aqueous dyeing liquid containing 4%, based on the weight of the fabric, of Duranol Blue G, 0.2 ml/l of acetic acid and 1 g/l of a dispersing agent (Disper TL), at a temperature of 120° C for 60 minutes. After the completion of dyeing, the fabric was squeezed and dried at a temperature of 120° C for 3 minutes. The fabric was subjected to shearing operations four times. The sheared fabric was finished with a polyurethane in the following manner. The fabric was immersed in an aqueous emulsion of a 4% polyurethane (Elastron E-37, a trademark of Daiichi Kogyo Seiyaku K.K., Japan), and squeezed in such a manner that 56%, based on the weight of the fabric, of the emulsion was maintained in the fabric. The fabric was dried at a temperature of 120° C for 3 minutes and, then, cured at a temperature of 150° C for 30 seconds. By the curing operation for the resin, the fabric was finally heat-set. The fabric was buffed three times by a roller sander machine with sand paper carrying thereon abrasive grains of 250 mesh size. Finally, the fabric was decatized at a temperature of 100° C for 2 minutes.

The resultant raised fabric had a deer skin-like appearance and feel. The resultant deer skin-like raised fabric also had a high resistance to pilling and fingermarks appeared on the surface thereof.

What we claim is:

1. A raised woven or knitted fabric having at least one raised surface, which comprises at least one yarn consisting of synthetic hollow composite fibers each composed of at least four alternating segments of fiber-forming polyester and fiber-forming polyamide in which composite fibers said polyester and polyamide segments are adhered and encompass the hollow core and extend along the longitudinal axes of said fibers to form a tube-shaped body, said polyester and polyamide segments of said composite fibers located in at least said raised surface portion of said fabric being separated from each other to form numerous very fine fibrils.

2. A raised woven or knitted fabric as claimed in claim 1, wherein the numbers of said polyester and polyamide constituents are 3 to 20, respectively.

3. A raised woven or knitted fabric as claimed in claim 1, wherein the ratio of the total weight of said polyester constituents to that of said polyamide constituents is between 30:70 and 70:30.

4. A raised woven or knitted fabric as claimed in claim 1, wherein said fiber-forming polyester is selected from the group consisting of (1) alkylene terephthalate homopolyesters in which the alkylene group is derived from polymethylene glycols of the formula: $HO-(CH_2)p-^{OH}$, wherein p represents an integer from 2 to 10; (2) alkylene terephthalate-metal sulfonate copolyesters in which the alkylene group is the same as defined above and the metal sulfonate group is of the formula:

$$-X-\underset{\underset{SO_3M}{|}}{Z}-Y-$$

wherein M represents a metal atom, X represents an atomic group of the formula:

$$-O-\underset{\underset{O}{\|}}{C}-O-,$$

$$-O-(CH_2)_n-[O-(CH_2)_n]_m-O-$$

$$-\underset{\underset{O}{\|}}{C}-[O-(CH_2)_n]_m-O-$$

wherein n represents an integer of 1 or more and m represents zero or an integer of 1 or more, Y represents the same atomic group as X or a hydrogen atom and Z represents a divalent arylene group or a divalent alkylene group which bonds said $-SO_3M$ group to said X group through at least three atoms; (3) alkylene terephthalate — third ingredient copolyesters, in which the alkylene group is the same as defined above and the third ingredient is derived from at least one compound selected from the group consisting of adipic acid, sebacic acid, isophthalic acid, diphenylsulfon-dicarboxylic acid, naphthalene-dicarboxylic acid, hydroxybenzoic acid, trimethylene glycol, propylene glycol, cyclohexanedimethanol and neopentyl glycol; (4) alkylene terephthalate-metal sulfonate — fourth ingredient copolyesters, in which the alkylene group and the metal sulfonate group are the same as defined above and the fourth ingredient is the same as the third ingredient defined in item (3) above, and; (5) mixtures of two or more of the above-mentioned homopolyesters and copolyesters.

5. A raised woven or knitted fabric as claimed in claim 4, wherein said alkylene terephthalate homopolyesters are either polyethylene terephthalate, or polytetramethylene terephthalate.

6. A raised woven or knitted fabric as claimed in claim 4, wherein said metal atom in said alkylene terephthalate copolyesters is selected from the group consisting of alkali metals and alkaline earth metals.

7. A raised woven or knitted fabric as claimed in claim 4, wherein said third ingredient in said alkylene terephthalate — third ingredient copolyester is in an amount of 10% or less, based on the amount by mole of the alkylene terephthalate ingredient.

8. A raised woven or knitted fabric as claimed in claim 4, wherein said fourth ingredient in said alkylene terephthalate-metal sulfonate — fourth ingredient copolyester is in an amount of 10% or less, based on the sum of the amounts by mole of the alkylene terephthalate ingredient and the metal sulfonate ingredient.

9. A raised woven or knitted fabric as claimed in claim 4, wherein said metal sulfonate group in said copolyesters of items (2) and (4) is derived from a metal salt of 3,5-dicarboxybenzene sulfonic acid.

10. A raised woven or knitted fabric as claimed in claim 4, wherein said metal sulfonate group in said copolyesters of items (2) and (4) is in an amount of 0.01 to 1.0%, based on the amount by mole of acid ingredient or ingredients in said copolyesters.

11. A raised woven or knitted fabric as claimed in claim 4, wherein said metal sulfonate group in the copolyester of item (2) is in an amount of 0.1 to 1.0%, based on the sum of the amounts by mole of the terephthalic acid ingredient and the metal sulfonate group.

12. A raised woven or knitted fabric as claimed in claim 4, wherein said metal sulfonate group in the copolyester of item (4) is in an amount of 0.1 to 1.0% based on the sum of the amounts of terephthalic acid ingredient, the metal sulfonate group and said fourth ingredient when it is an acid.

13. A raised woven or knitted fabric as claimed in claim 1, wherein said fiber-forming polyamide is selected from the group consisting of nylon 4, nylon 6, nylon 66, nylon 7, nylon 610, nylon 11, nylon 12, polyamides of bis(p-amino-cyclohexyl)methane with 1,7-heptanedicarboxylic acid and 1,10-decamethylene dicarboxylic acid, copolyamides of two or more of above-mentioned polyamides and mixtures of two or more of the above-mentioned polyamides and copolyamides.

14. A raised woven or knitted fabric as claimed in claim 1, wherein the hollow ratio by volume of said hollow space to the sum of the polyamide and polyester constituents and the hollow space, is between 0.1 and 15%.

15. A raised woven or knitted fabric as claimed in claim 14, wherein the hollow ratio is between 1 and 10%.

16. A raised woven or knitted fabric as claimed in claim 1, wherein the individual polyester and polyamide constituents respectively have a denier of from 0.0001 to 0.4.

17. A raised woven or knitted fabric as claimed in claim 16, wherein said denier of said individual constituents is in a range from 0.02 to 0.3.

18. A raised woven or knitted fabric as claimed in claim 1, wherein said hollow composite fibers have a tensile strength of 2 to 6 g/denier.

19. A raised woven or knitted fabric as claimed in claim 18, wherein said tensile strength of said hollow composite fibers is in a range from 3.5 to 5.0 g/denier.

20. A raised woven or knitted fabric as claimed in claim 1, wherein said hollow composite fiber yarn is in the form of a continuous filament yarn.

21. A raised woven or knitted fabric as claimed in claim 20, wherein said filament yarn is a straight filament yarn.

22. A raised woven or knitted fabric as claimed in claim 20, wherein said filament yarn is a textured filament yarn.

23. A raised woven of knitted fabric as claimed in claim 1, wherein said hollow composite fiber yarn is a spun yarn.

24. A raised woven or knitted fabric as claimed in claim 1, wherein said fabric is finished by impregnating it with a finishing resin.

25. A raised woven or knitted fabric as claimed in claim 24, wherein said finishing resin is an elastic polymer.

26. A raised woven or knitted fabric as claimed in claim 1, wherein said fabric is a woven fabric composed of a weft yarn consisting of said hollow composite fibers and a warp yarn consisting of fibers other than said hollow composite fibers.

27. A raised woven or knitted fabric as claimed in claim 26, wherein said warp yarn forming fibers are dope-dyed fibers.

28. A raised woven or knitted fabric as claimed in claim 1, wherein said very fine fibrils have a wedge-shaped cross-sectional profile.

29. A process for producing a raised woven or knitted fabric having at least one raised surface, which comprises:

providing synthetic hollow composite fibers each composed of at least two constituents consisting of a fiber-forming polyester and at least two constituents consisting of a fiber-forming polyamide and having a hollow space formed within said fiber, in which fiber said polyester and polyamide constituents and said hollow space extend along the longitudinal axis of said fiber, and said polyester constituents and said polyamide constituents are arranged alternately with each other around said hollow space and adhered to each other side-by-side to form a tube-shaped body;

forming a yarn from said synthetic composite fibers;

providing a woven or knitted fabric comprising at least one said yarn, and;

raising at least one surface of said fabric while allowing said hollow composite fibers located in at least said raised surface to be divided into very fine fibrils consisting of said polyester and polyamide constituents.

30. A process as claimed in claim 29, wherein said woven or knitted fabric is relaxed.

31. A process as claimed in claim 30, wherein in said relaxing operation, said hollow composite fibers are shrunk at a shrinkage of 20% or less.

32. A process as claimed in claim 31, wherein the shrinkage of said hollow composite fibers is in a range between 8 and 12%.

33. A process as claimed in claim 30, wherein said relaxing operation is carried out by immersing said woven or knitted fabric in a hot water bath having a temperature of 40° to 100° C.

34. A process as claimed in claim 30, wherein said relaxing operation is carried out by bringing said woven or knitted fabric into contact with flows of steam at a temperature of 80° to 140° C.

35. A process as claimed in claim 30, wherein said relaxing operation is carried out by bringing said woven or knitted fabric into contact with jets of hot air at a temperature of 100° to 160° C.

36. A process as claimed in claim 30, wherein said relaxing operation is applied to said woven or knitted fabric after said raising operation.

37. A process as claimed in claim 30, wherein said relaxing operation is applied to said woven or knitted fabric before said raising operation.

38. A process as claimed in claim 36, wherein said relaxed fabric is raised again.

39. A process as claimed in claim 29, wherein said raised fabric is finished by impregnating said fabric with a finishing resin in an amount of 0.1 to 5.0% based on the weight of said fabric.

40. A process as claimed in claim 39, wherein said resin-finishing is carried out after said fabric is dyed.

* * * * *

UNITED STATES PATENT OFFICE
CERTIFICATE OF CORRECTION

Patent No. 4,051,287 Dated September 27, 1977

Inventor(s) Kazushige Hayashi, et al

It is certified that error appears in the above-identified patent and that said Letters Patent are hereby corrected as shown below:

Column 5, line 54: "in" should be --In--.

Column 7, line 3: "a" should be --A--.

Column 8, line 6: "It" should be --If--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*